US005452566A

United States Patent [19]

Benhamou et al.

[11] Patent Number: 5,452,566

[45] Date of Patent: Sep. 26, 1995

[54] DEVICE FOR HANDLING AND MAINTENANCE OF THE FREE END OF A FILM IN A WRAPPING MACHINE

[75] Inventors: Aimé Benhamou, Villecresnes; Michel Bregier, Le Belved`ere; Hans Niewenhuis, Beinsdorp; Daniel Pioffet, Le Bretonneux, all of France

[73] Assignee: ITW Mima-Europe, Aubervilliers, France

[21] Appl. No.: 266,412

[22] Filed: Jun. 27, 1994

[30] Foreign Application Priority Data

Jun. 25, 1993 [FR] France ..... 93 07759

[51] Int. Cl.[6] ..... B65B 53/00

[52] U.S. Cl. ..... 53/556; 53/389.3; 53/587; 53/588

[58] Field of Search ..... 53/556, 587, 588, 53/441, 389.3

[56] References Cited

U.S. PATENT DOCUMENTS

| | | | |
|---|---|---|---|
| 4,152,879 | 5/1979 | Shulman | 53/399 |
| 4,216,640 | 8/1980 | Kaufman | 53/556 |
| 4,235,062 | 11/1980 | Lancaster, III et al. | 53/556 |
| 4,432,185 | 2/1984 | Geisinger | 53/138 R |
| 4,619,102 | 10/1986 | Geisinger | 53/399 |
| 4,995,224 | 2/1991 | Yourgalite et al. | 53/588 |
| 5,088,270 | 2/1992 | Diehl | 53/441 |

FOREIGN PATENT DOCUMENTS 2143200 2/1985 United Kingdom .

*Primary Examiner*—John Sipos
*Assistant Examiner*—Gene L. Kim
*Attorney, Agent, or Firm*—Schwartz & Weinrieb

[57] ABSTRACT

A machine for packing by wrapping a load (1) comprises a device for supplying a pre-drawn film (3) propelled with respect to a longitudinal axis (6) of the load (1) to be packed with a relative helicoidal movement, and a device for handling of the free end of the film (3) between two wrapping cycles in accordance with the invention comprises a plate (10) for holding of the film (3) against the load (1), the length of which is at least equal to the width of the film (3) used, and near one of the long edges of this plate (10), a pair of jaws (13, 14) mobile with respect to one another along this edge are provided to crumple and grip between them the portion of the film contained between the plate and the film-supply device.

20 Claims, 3 Drawing Sheets

DEVICE FOR HANDLING AND MAINTENANCE OF THE FREE END OF A FILM IN A WRAPPING MACHINE

FIELD OF THE INVENTION

This invention relates to a machine for wrapping a load.

BACKGROUND OF THE INVENTION

The techniques of packing a load by wrapping have as their principal function to endow the load formed as a pile with the necessary cohesion so as to preserve the stability of the pile at the time of its handling.

The method used to ensure this cohesion is a drawable film which is wound in the drawn state around the pile under a predetermined amount of low tension, the film having a tendency to retract slightly and to lie flat on the load. In general, at least two layers of winding are effected.

Among the machines used for the implementation of this packing technique, there are those in which the load revolves in relation to a fixed source of supply of pre-drawn film, and those in which the load is fixed, with the film-supply source revolving around such load. In these two categories, the film supply source comprises a spool of film combined with a pre-drawing device and is vertically mobile along its support (if the axis of the load is vertical) so as to be able to sweep the entire height of the load with a helicoidal winding.

The main problems still to be resolved for this type of machine relate to the beginning and end of a wrapping cycle. Indeed, at the beginning of each cycle, it is necessary to make the end of the film integral with the load so that the unwinding of this film results from the relative revolution of the load and the film-supply source. It is necessary, at the end of the cycle, to cut the film by "attaching" one of the ends to the load while the other end is preserved so as to then be applied to a subsequent load.

OBJECT OF THE INVENTION

This invention seeks to propose a simple device to ensure these functions at the beginning and end of the wrapping cycle, and in addition making it possible to improve the finishing quality of the packing and the speed of execution of such operations at the beginning and end of the cycle.

SUMMARY OF THE INVENTION

To this end, the purpose of the present invention is achieved through the provision of a machine for packing by wrapping of a load comprising a device for supplying a pre-drawn film, propelled in relation to a longitudinal axis of the load to be packed with a relative helicoidal movement, a device for handling the free end of the film between two wrapping cycles which consists of a plate for holding the film against the load, the length of which is at least equal to the width of the film used and, close to one of the long edges of this plate, a pair of jaws mobile with respect to one another along this edge so as to crumple and grip between them the portion of film contained between the plate applied to the load and the film-supply device.

These integral jaws movable with the film-holder plate on the load at the conclusion of wrapping offer several advantages. It will be recalled, first of all, that the principal function of this plate is to attach the end of the film to the load. This attachment may be accomplished either by pressure if the film is slightly adhesive or, most often, by thermo-sealing, the plate being capable of being heated. The first advantage of the jaws being integral and movable with the plate resides in the fact that they are located in the immediate area of this plate and their operation, which consists in gathering the film into a core, produces on this film, interactively with one of the edges of the plate, a tearing force which can be used advantageously to obtain free end of the film which is integral with the load very close to the attachment area. The finishing of the packing is thus greatly improved, as the loose-hanging end of the film, which at the time of handling or stocking constitutes a starting point for unwinding of the film if this end happens to become caught or to be pulled inopportunely in a malicious manner, is eliminated.

The second advantage of this arrangement resides in the possibility of stopping the wrapping at any point whatsoever on the outer surface of the load. Indeed, in the present machines, stoppage of the wrapping is most often implemented in a low position, after having passed the film through the last turn, by means of a clamp fixed in relation to the load with which it might be kept after cutting.

Another advantage of this arrangement resides in the fact that the film, when it is clamped between the jaws, is formed into a core which effectively transmits the pull which must be imposed on the film, specifically at the beginning of each wrapping cycle, which makes it possible to pick up speed rapidly without worrying about a break in the film.

In order to be able to apply the holding plate against the load with the film between the plate and the load, the plate and the jaws are installed at the end of a mobile support which is movable perpendicular to the axis of the load. In addition, so as to be able to select the level at which the wrapping will be stopped, the support is movable along a stationary guide parallel to the axis of the load.

In addition, the device comprises a clamp which is fixed with respect to the load and which is located at the level of one of its longitudinal ends, the positioning of which is, at the end of the wrapping cycle, located between the film-supply device and the film-gripping jaws, in the area of the path of these jaws at the time of the operation of the support with respect to the load. With the aid of this arrangement, it is possible to transfer the end of the film crumpled into the form of a core from the jaws to a fixed clamp so that the film delivered by the device supplying the pre-drawn film is ready to begin another wrapping cycle.

Finally, an additional feature of the present invention, which resides in the provision of a means for tearing of the film located between the jaws and the edge of the pressure plate, will be noted. This means for tearing, or more precisely for aiding or serving as a starting point for such tearing, can be a simple edge of the plate or a hot wire arranged between this plate and the jaws.

BRIEF DESCRIPTION OF THE DRAWINGS

Other features and advantages of the invention will be evident from the description thereof presented below, by way of example, and in reference to the attached drawings, in which like reference characters designate like or corresponding parts throughout the several views, and wherein.

DETAILED DESCRIPTION OF THE PREFERRED EMBODIMENT

Figure 1:
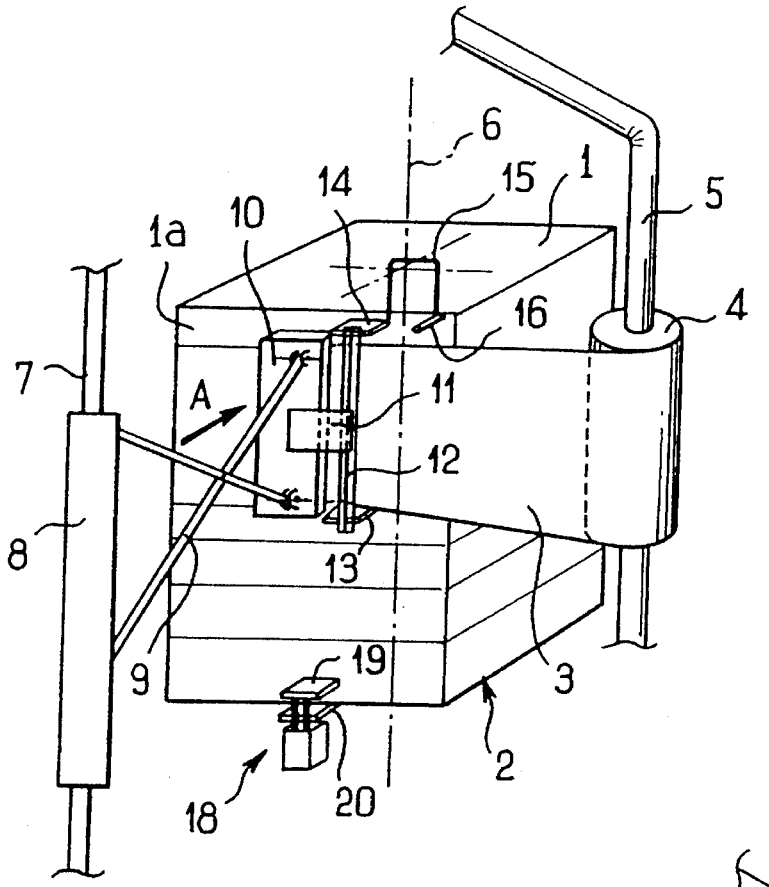
FIGS. 1 to 5 are schematic perspective diagrams illustrating the various phases of functioning of the invention during a load-wrapping cycle.

In FIGS. 1 to 5, a load 1 has been depicted, here in the form of a right-angled parallelepiped resting on its lower surface 2 on a support not illustrated in a machine which comprises a device for supplying a pre-drawn wrapping film 3, this device being depicted here simply by a spool 4 and a support 5 for the spool 4.

As recalled above, in accordance with this type of wrapping machine, either the load 1 revolves around its longitudinal axis 6 and the device for supplying of film 3 is stationary with respect to this axis 6 in a revolutionary orientation or mode but describes a reciprocating vertical movement along the support 5, or the load 1 is stationary and the device for supplying the film 3 revolves around the axis 6 while also undergoing a reciprocating vertical movement in relation to the load. In any case, it is this relative rotation of the load and the device for supplying the film 3 which produces the wrapping.

The machine of the invention comprises a fixed frame, a component 7 of which constitutes a slide for a support carrier 8 for an unfolding arm 9 for a plate 10 which is designed to hold the film 3 against the load 2 at the conclusion of the wrapping operation. The plate 10 is connected by a bracket indicated as 11 to a set of slides 12 for a pair of mobile jaws 13 and 14 which are movable along the set of slides 12 which is disposed parallel to one of the edges 10*a* of the plate 10. The set of slides 12, and consequently the jaws 13 and 14, are located between the plate 10, in the immediate area thereof, and the device for supplying the film 3.

In addition, the upper jaw 14 is equipped with a stirrup 15 in the direction of the film-supply device, this stirrup extending above the plane of the jaw 14 and having at its free end, perceptibly in the plane of the jaw 14, a finger 16 the function of which will be explained below.

When the wrapping operation is completed, the load 1 has its surface 1*a* disposed opposite the frame component 7. The automatic control mechanism of the machine adjusts the height of the carrier 8 and unfolds the arm 9 so that the plate 10 comes to rest on the surface 1*a*, pressing the film 3 onto this surface 1*a* as illustrated by the arrow A. Prior to this movement, the jaws 13 and 14 have been moved away from one another with the aid of a jack-type means of operation, along the slides 12, the distance separating them when they are disposed away from each other being greater than the width of the film 3 wrapped around the load 1.

Figure 2:
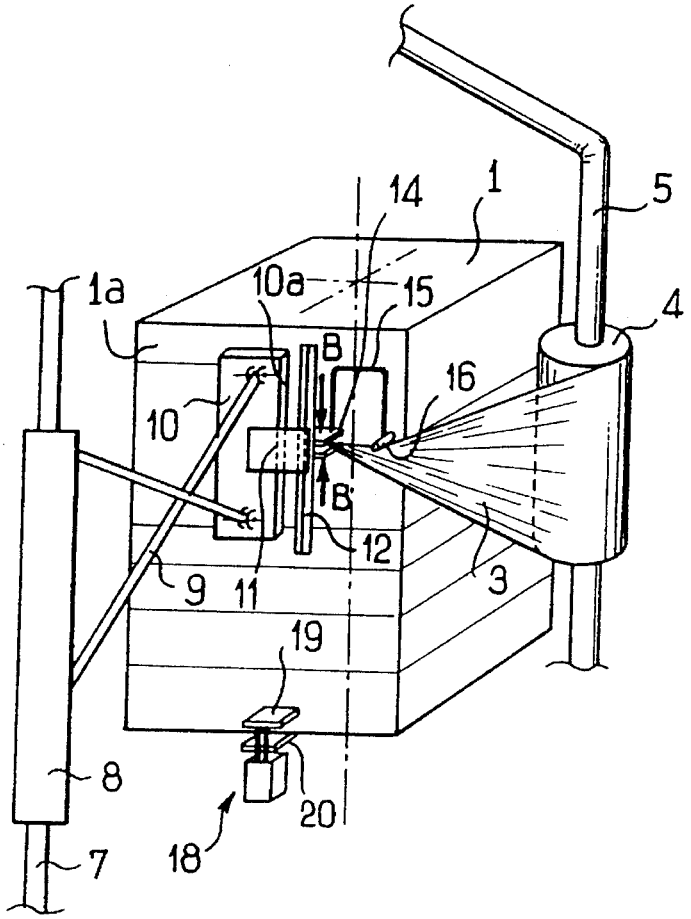

As represented in FIG. 2, the jaws 13 and 14, when the plate 10 is held on the surface 1*a* of the load, are drawn closer to one another in accordance with the arrows B.

In accordance with a preferred mode of the present invention, each of the jaws preferably travels one half the distance which separates it from the other, but it is not outside the context of the invention to contemplate, for example, a fixed lower jaw 13 and a mobile upper jaw 14 which travels over the entire length of the slides 12. As the jaws draw closer to one another, the film 3 is crumpled between them and a pull is produced thereon which, as viewed in the figure, brings about its breaking or tearing at a location which is to the right of the side 10*a* of the plate 10. As a matter of fact, it may be desirable to implement this side 10*a* in such a way that it has a relatively hard, sharp edge so that, upon contact with this edge, at the time of crumpling of the film by the jaws 13 and 14, a starting point for breaking and a tearing of the film is produced.

It will be recalled that the plate 10 can be a thermo-sealing heating plate which can be activated in connection with the last turn of the film on the load.

Figure 3:
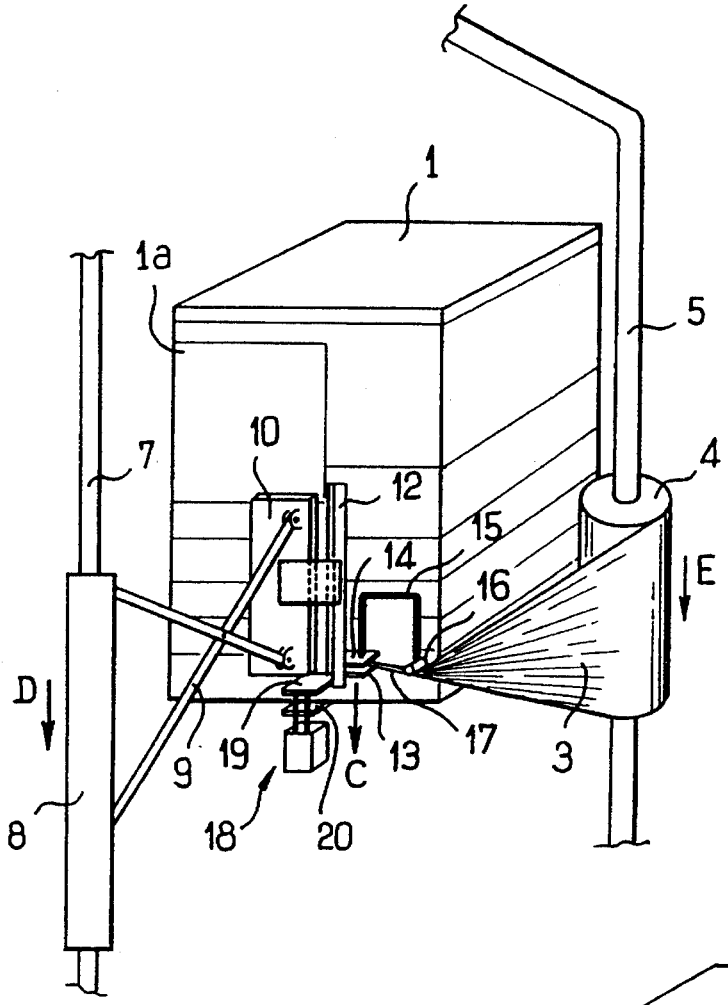
Figure 4:
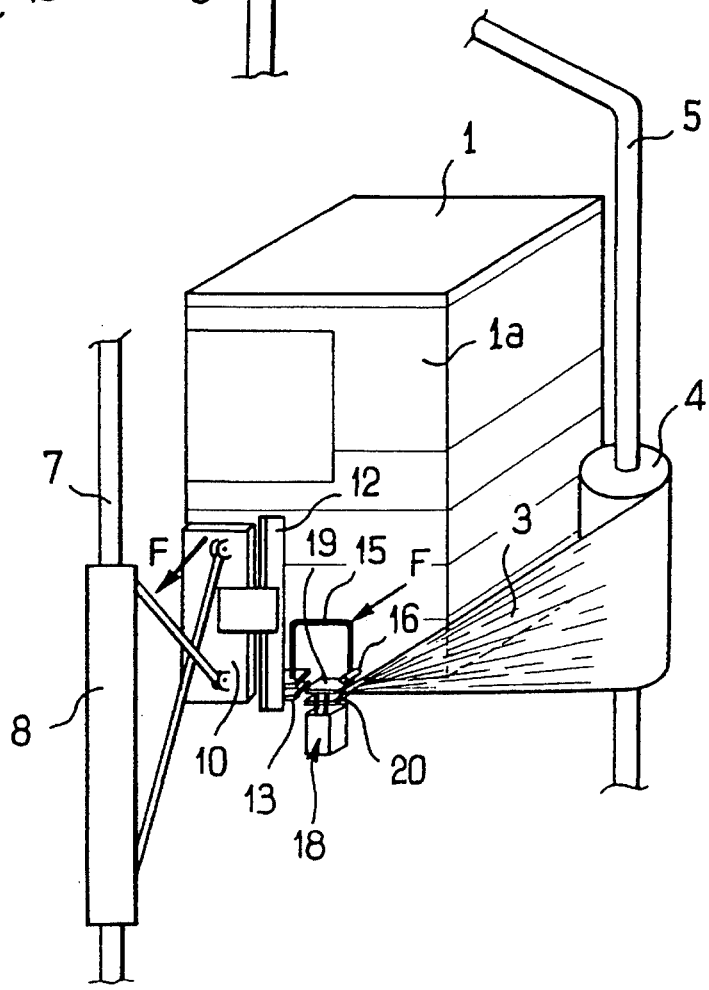
Figure 5:
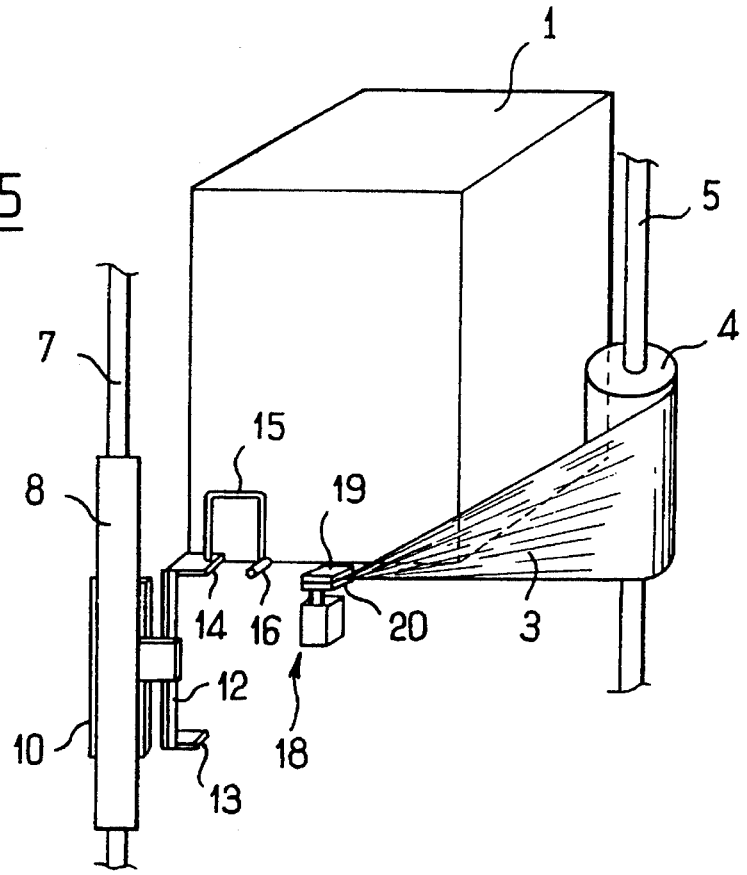

The crumpled film held between the jaws 13 and 14 thus forms a sort of core which remains gathered together in a stump 17 outside the jaws with the aid of the finger 16 as illustrated by FIG. 3.

As a matter of fact, the condition of the machine depicted in this figure results on the one hand from the simultaneous lowering of the two jaws 13 and 14 to a position located at the lower portion of the slides 12, as the arrow C indicates, and on the other hand, the general descent of the carrier 8 and the spool 4 as indicated by the arrows D and E. Of course, prior to this operation of descent along the surface 1*a* of the load, there was a slight loosening of the plate 10 with respect to this surface through retraction of the unfolding arms 9 so as not to interfere with the wrapping covering the surface 1*a* of the load.

In the condition depicted in FIG. 3, the base of the spool 4 is located at the level of the finger 16 and the jaws 13 and 14, so that the finger 16 forces the film to come together along its lower edge which forms the portion of core 17 between this finger and the jaws 13, 14.

The presence of a clamp 18 which is borne by a support not depicted, integral with or joined to the support for the load 1 is also noted in FIGS. 1 to 5. This clamp 18 comprises two small plates 19 and 20 capable of being moved apart from one another and drawn together vertically. These small plates form jaws for this clamp which is located at the level of the lower surface 2 of the load on which the latter rests on its support. The control mechanism for opening and closing of the clamp 18 is conventional and will not be described. The clamp 18 is located near the side of the surface 1*a* of the load when the latter is stopped and between this surface and the frame component 7 which bears the carrier 8.

The automatic control mechanism of the machine which implemented the descent in accordance with arrows C, D and E of all the mobile equipment described above is such that at the end of such movements, as depicted in FIG. 3, the film stump 17 formed into a core is disposed opposite the two jaws 19 and 20 of the open clamp 18. A movement in accordance with the arrow F in FIG. 4 of the plate 10 in the direction of the carrier 8 introduces the film portion 17 in the form of a core between the two jaws 19 and 20. A detection of the presence of the core between the jaws 19 and 20 or a detection of the position of the mobile equipment in this intermediate position makes it possible to control the closing of the clamp on the film. When this closing is ensured, the jaws 13 and 14 can open and move away from one another along the slides 12, and the retraction of the deformable arm 9 can continue until achieving the configuration of the machine depicted in FIG. 5.

The wrapped load can then be extracted from the machine and a new load to be wrapped can be provided. Indeed it is noted in FIG. 5 that the clamp 18 holds the film 3 in a position such that the relative movement of the new load with respect to the film-supply device leads to the wrapping of the new load. When one or two helical turns are carried out, the clamp 18 opens and the portion of film which extends between the clamp 18 and the load 1 is released. To prevent this portion of film from hanging at the end of the wrapping, it can be advantageous to provide for a vertical blast of air under the load which has the effect of bringing this portion of released film back against the load so that the following turns succeed in keeping it there.

In variants of the present invention not depicted, it can also be contemplated that the clamp 18 is retractable between an upper level where it is in a service position, that is, capable of intercepting the film in the form of a stump or core 17, and a lower level located under the lower surface 2 of the load where it is retracted in order to permit, for example, the making of a very low turn which is to cover the lower edges of the load.

Likewise, and in case the load might rest on a revolving table, this table can comprise one or several other clamp 18 opposite each of the lateral surfaces of the load, which would make it possible to stop the wrapping opposite any surface whatsoever and in terms of the position of the load intake and discharge conveyors on the revolving table. If the clamp 18 is not installed in a retractable manner with respect to the lower surface of the load, it will be necessary to limit the number of clamps 18 to two arranged opposite two adjacent surfaces of the load so as to leave two load access and discharge sides free opposite these clamps.

Figure 6:
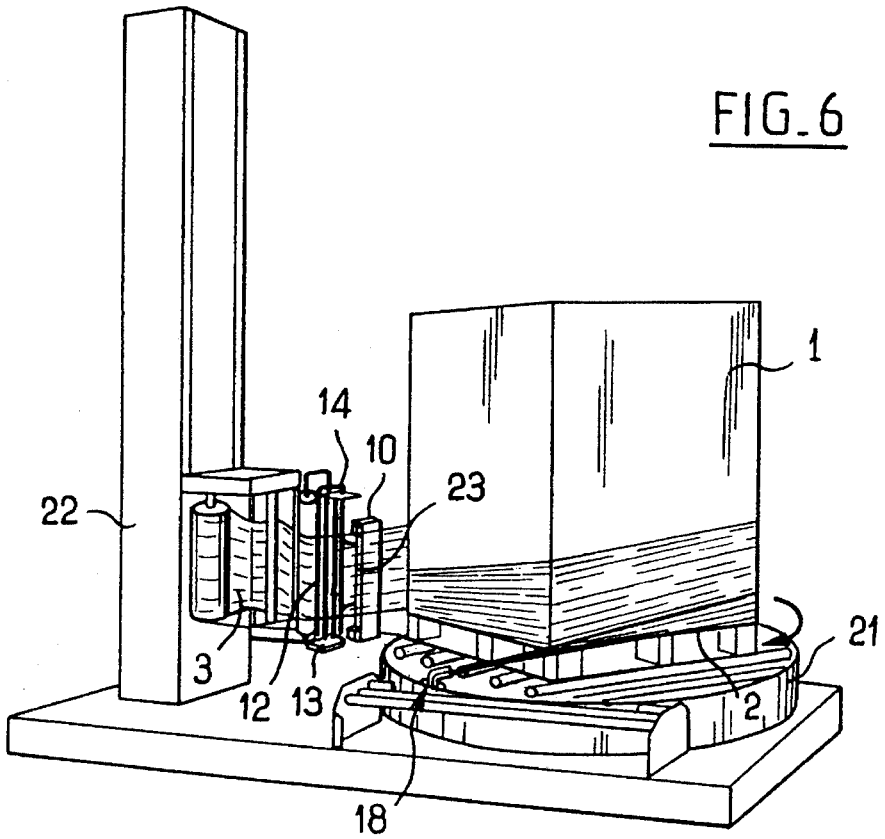
FIG. 6 is a general view of a wrapping device to which the methods of the invention are applied.

FIG. 6 is an illustration of an industrial embodiment of a machine constructed in accordance with the invention, in which the load 1 rests on a revolving platen 21 while the device for supplying the film 3 and the carrier supporting the unfoldable arm, the plate 10 and the jaws 13 and 14, are installed so as to be vertically movable along a pole 22 integral with the frame of the machine.

There will be noted in this Figure, between the plate 10 and the slides 12 for sliding of the jaws 13 and 14, the presence of a heating wire 23 near which the jaws 13 and 14 can be drawn together, this heating wire constituting, when the plate 10 is held against one of the surfaces of the load 1, a means of starting the breaking of the film, which will be torn more easily when the jaws 13 and 14 draw toward one another. This hot wire can be replaced in accordance with a variant of the invention not depicted by a sharp edge which is supported by the wire and which can constitute a sort of fixed blade for cutting the film when the jaws 13 and 14 draw together. Of course, all the elements already described, with the same references, are found in this FIG. 6.

Obviously, many modifications and variations of the present invention are possible in light of the above teachings. It is therefore to be understood that within the scope of the appended claims, the present invention may be practiced otherwise than as specifically described herein.

We claim:

1. Apparatus for packaging a load by wrapping said load within a film having a predetermined width, wherein said load has a longitudinal axis, comprising:

means for supplying said film toward said load to be wrapped, and movable relatively with respect to said load to be wrapped so as to be able to wrap said film about said load in a helicoidal manner;

means, movable toward and away from said load, and also movable in a longitudinal direction parallel to said longitudinal axis of said load, comprising a surface for engaging an outermost layer portion of said film being wrapped about said load and for holding said outermost layer portion of said film against said load;

a pair of jaws, interposed between said film engaging means and said film supply means, and movable toward and away from each other in a longitudinal direction parallel to said longitudinal axis of said load and across said width of said film, for gripping and crumpling a portion of said film by reducing said width of said film as a result of relative movement of said jaws toward each other and across said width of said film while said film engaging means holds said outermost layer portion of said film against said load; and means interposed between said surface of said film engaging means and said pair of jaws for causing separation of said portion of said film from said outermost layer portion of said film wrapped about said load as said pair of jaws move relative to each other and across said width of said film while gripping and crumpling said portion of said film.

2. Apparatus as set forth in claim 1, wherein:

said means for supplying said film toward said load comprises additional means for moving said film supplying means in a reciprocating manner in a longitudinal direction parallel to said longitudinal axis of said load.

3. Apparatus as set forth in claim 2, wherein:

said means for supplying said film comprises a spool of film.

4. Apparatus as set forth in claim 1, further comprising:

a frame member;

a support carrier slidably movable upon said frame member in a longitudinal direction parallel to said longitudinal axis of said load;

said movable means for engaging said film comprises a plate member; and collapsible/extensible arms interconnecting said plate member to said support carrier for permitting said plate member to be movable toward and away from said load in a direction perpendicular to said longitudinal direction in response to movement of said collapsible/extensible arms, and for permitting said plate member to be movable in said longitudinal direction parallel to said longitudinal axis in response to movement of said support carrier in said longitudinal direction parallel to said longitudinal axis of said load.

5. Apparatus as set forth in claim 4, further comprising:

slide bars for slidably mounting said pair of jaws; and means fixedly interconnecting said slide bars to said plate member such that said slide bars are movable with said plate member relative to said load and said frame member by said support carrier and said collapsible/extensible arms.

6. Apparatus as set forth in claim 1, further comprising:

a finger fixedly mounted upon one of said pair of jaws for cooperating with said one of said pair of jaws so as to define a core portion of said gripped and crumpled portion of said film.

7. Apparatus as set forth in claim 6, further comprising:

stirrup means fixedly connected to said one of said pair of jaws for fixedly mounting said finger in a laterally spaced position with respect to said one of said pair of jaws so as to permit said one of said pair of jaws and said laterally spaced finger to define said core portion of said gripped and crumpled portion of said film therebetween; and clamp means movably mounted so as to be selectively interposed between said one of said pair of jaws and said finger for grasping said core portion of said gripped and crumpled portion of said film and thereby permit said pair of jaws to release said gripped and crumpled portion of said film whereupon said pair of jaws may be moved away from said film in preparation for a subsequent wrapping cycle.

8. Apparatus as set forth in claim 4, further comprising wherein said means for causing separation of said portion of said film comprises:

a heating wire disposed adjacent to said plate member for facilitating said separating of said gripped and crumpled portion of said film from said outermost layer portion of said film wrapped about said load.

9. Apparatus as set forth in claim 4, further comprising wherein said means for causing separation of said portion of said film comprises:

a cutting blade disposed adjacent to said plate member for facilitating said separating of said gripped and crumpled portion of said film from said outermost layer portion of said film wrapped about said load.

10. Apparatus as set forth in claim 4, wherein:

a sharp edge portion provided upon said plate member comprises said means for causing separation of said portion of said film from said outermost layer portion of said film wrapped about said load.

11. Apparatus for packaging a load by wrapping said load with a film having a predetermined width, wherein said load has a longitudinal axis, and for handling a portion of said film between wrapping cycles wherein said film portion comprises an end portion of said film with respect to a predetermined wrapping cycle, and a beginning portion of said film with respect to a subsequent wrapping cycle, comprising:

means for supplying a film, having a predetermined width, toward a load to be wrapped, and relatively movable with respect to said load to be wrapped so as to be able to wrap said film about said load;

means, movable toward and away from said load, comprising a surface for engaging an outermost layer portion of said film being wrapped about said load so as to hold said outermost layer portion of said film against said load when a predetermined wrapping cycle has been completed;

first clamping means, interposed between said means for engaging said outermost layer portion of said film and said means for supplying said film, and movable toward and away from each other in a direction extending across said width of said film, for gripping and crumpling a portion of said film which defines a terminal end portion of said film wrapped about said load, by reducing said width of said film as a result of relative movement of said first clamping means toward each other and across said width of said film while said means for engaging said outermost layer portion of said film is engaged with said outermost layer-portion of said film;

means interposed between said surface of said film engaging means and said first clamping means for causing separation of said portion of said film from said outermost layer portion of said film wrapped about said load as said first clamping means move toward each other and across said width of said film while gripping and crumpling said portion of said film; and second clamping means, interposed between said first clamping means and said means for supplying said film, for grasping said gripped and crumpled portion of said film which defines said terminal end portion of said film wrapped about said load, so as to permit said first clamping means to release said terminal end portion of said film and be moved away from said load while said second clamping means continues to grasp said gripped and crumpled portion of said film so as to define a beginning portion of said film with respect to a subsequent wrapping cycle in connection with a subsequent load.

12. Apparatus as set forth in claim 11, wherein:

said means for supplying said film comprises a spool reciprocatingly mounted for movement in a longitudinal direction parallel to said longitudinal axis of said load so as to permit helicoidal wrapping of said film about said load.

13. Apparatus as set forth in claim 11, wherein:

said means movable toward and away from said load for engaging said outermost layer portion of said film comprises a plate member; and said first clamping means comprises a pair of jaws movable toward and away from each other in a longitudinal direction parallel to said longitudinal axis of said load upon slide bar means fixedly connected to said plate member for movement therewith.

14. Apparatus as set forth in claim 13, further comprising:

a frame member;

a support carrier slidably movable upon said frame member in a longitudinal direction parallel to said longitudinal axis of said load;

collapsible/extensible arms interconnecting said plate member and said support carrier for permitting said plate member to be movable toward and away from said load in a direction perpendicular to said longitudinal direction; and bracket means fixedly interconnecting said slide bar means for said pair of jaws and said plate member.

15. Apparatus as set forth in claim 11, further comprising:

finger means fixedly mounted upon said first clamping means for cooperating therewith so as to define said beginning portion of said film for said subsequent wrapping cycle.

16. Apparatus as set forth in claim 15, further comprising:

stirrup means fixedly connected to said first clamping means for fixedly mounting said finger means in a laterally spaced position with respect to said first clamping means so as to permit said first clamping means and said laterally spaced finger to define said beginning portion of said film therebetween for grasped engagement by said second clamping means.

17. Apparatus as set forth in claim 13, further comprising wherein said means for causing separation of said portion of said film comprises:

a heating wire disposed adjacent to said plate member for facilitating said separating of said gripped and crumpled portion of said film from said outermost layer portion of said film wrapped about said load.

18. Apparatus as set forth in claim 13, further comprising wherein said means for causing separation of said portion of said film comprises:

a cutting blade disposed adjacent to said plate member for facilitating said separating of said gripped and crumpled portion of said film from said outermost layer portion of said film wrapped about said load.

19. Apparatus as set forth in claim 13, wherein:

a sharp edge portion provided upon said plate member comprises said means for causing separation of said portion of said film from said outermost layer portion of said film wrapped about said load.

20. Apparatus as set forth in claim 11, wherein:

said second clamping means comprises a pair of jaws movable toward and away from each other in a longitudinal direction parallel to said longitudinal axis of said load.

* * * * *